US005520748A

United States Patent [19]

Yang et al.

[11] Patent Number: 5,520,748

[45] Date of Patent: May 28, 1996

[54] PROCESS FOR MANUFACTURING ALNICO SYSTEM PERMANENT MAGNET

[75] Inventors: Choong J. Yang; Seung D. Choi; Woo Y. Lee; Young G. Son, all of Pohang, Rep. of Korea

[73] Assignees: Pohang Iron & Steel Co., Ltd.; Research Institute of Industrial Science & Technology, both of Kyong Sang Book-do, Rep. of Korea

[21] Appl. No.: 397,180

[22] Filed: Mar. 9, 1995

[30] Foreign Application Priority Data

Jul. 27, 1993 [KR] Rep. of Korea ..... 1993/14285

[51] Int. Cl.[6] ..... H01F 1/03

[52] U.S. Cl. ..... 148/104; 148/102; 75/334; 419/29; 419/54

[58] Field of Search ..... 148/101, 102, 148/103, 104; 75/334, 348; 419/29, 54

[56] References Cited

U.S. PATENT DOCUMENTS

| | | | |
|---|---|---|---|
| 2,192,741 | 3/1940 | Howe | 148/102 |
| 2,546,047 | 3/1951 | Studders | 148/103 |
| 2,694,790 | 11/1954 | Studders | 148/103 |
| 3,226,266 | 12/1965 | Jesimont et al. | 148/102 |
| 3,428,498 | 2/1969 | Heimke | 148/101 |
| 4,342,608 | 8/1982 | Willens | 148/101 |

FOREIGN PATENT DOCUMENTS

| | | | |
|---|---|---|---|
| 14-024213 | 10/1939 | Japan . | |
| 16-009284 | 5/1941 | Japan . | |
| 57-060804 | 4/1982 | Japan . | |
| 57-207101 | 12/1982 | Japan . | |
| 59-190338 | 10/1984 | Japan . | |
| 60-103150 | 6/1985 | Japan . | |
| 60-100647 | 6/1985 | Japan . | |
| 60-230957 | 11/1985 | Japan . | |
| 61-015933 | 1/1986 | Japan . | |
| 61-127848 | 6/1986 | Japan . | |
| 486071 | 9/1975 | U.S.S.R. | 148/101 |
| 583411 | 12/1946 | United Kingdom . | |

*Primary Examiner*—John Sheehan

*Attorney, Agent, or Firm*—Webb Ziesenheim Bruening Logsdon Orkin & Hanson

[57] ABSTRACT

A process for manufacturing an Alnico system permanent magnet is disclosed in which the alloy powder of the Alnico system having the proper composition is manufactured through a rapid solidification process, so that the crushability and the formability should be superior, the sintered density should be high, and the magnetic properties should be excellent, as well as cheap in its manufacturing cost and simple in its manufacturing process. An alloy of Alnico system is subjected to a rapid solidification with a spinning solidifier wheel speed of 6–40 m/sec, thereby manufacturing a microcrystalline rapidly solidified powder. The powder is ground into a finer powder, and then a press-forming is carried out. Then a sintering is carried out at a temperature of 1100°–1350° C. for 0.5–4 hours. Then based on a single heat treatment, an external magnetizing force of 1–15 kOe is applied in a temperature range of 600°–1000° C., thereby carrying out a heat treatment under a magnetizing force. Thereafter, an aging heat treatment is carried out at a temperature of 500°–700° C. for 1–10 hours, thereby magnetizing the formed body.

2 Claims, No Drawings

PROCESS FOR MANUFACTURING ALNICO SYSTEM PERMANENT MAGNET

FIELD OF THE INVENTION

The present invention relates to a process for manufacturing an Alnico system permanent magnet, in which a magnetic alloy for an Alnico system permanent magnet is formed into a micro-crystalline powder based on a rapid solidification method, then the powder is further ground to a proper particle size, then a fabrication is carried out, and then, the fabricated body is heat-treated, thereby completing the manufacturing of the Alnico system permanent magnet.

BACKGROUND OF THE INVENTION

The Alnico system permanent magnet which contains as the major ingredients Al, Ni, Co and Fe, or Al, Ni, and Fe is generally manufactured based on the melt casting method (Japanese Patent Gazette No. Sho-41-9284, and Sho-39-24213). However, the permanent magnet manufactured based on this method is hard and brittle, and therefore, the machining is extremely difficult. Therefore, permanent magnets which are small and of a complicated shape are manufactured based on a powder metallurgical method (Japanese Patent Gazette Sho-57-207101 and Sho-61-127848). Further, it can be manufactured in the form of a thin tape by spraying on a roll after the melting by using a nozzle (Japanese Patent Gazette Sho-57-60804). However, the permanent magnets which are made based on this method are weak in their magnetic properties, and therefore, have no actual usefulness. Meanwhile, when the Alnico system permanent magnet is manufactured based on the powder metallurgy, the ingredients are respectively measured, and are mixed together. Then press forming, sintering and heat treatment under a magnetic field are to be carried out.

Here the precursor powder used as the raw material is as follows.

(1) Proper quantities of the powders of metal element constituting the magnet are mixed together.

(2) Easily oxidizing metals such as Al or Ti is alloyed with Fe in advance to form an Fe—Al, or Fe—Ti alloy, and then, other metal group powders are mixed with the former.

(3) Together with the powders of Items (1) and (2), another magnet alloy powder which is obtained by spraying melts of the alloy containing a magnetic ingredient is used.

However, when manufacturing the Alnico system permanent magnet by using the above powders as the raw material, there are accompanied by the following disadvantages. That is, when using the powder of Item (1), the easily oxidizing metal such as Al, Ti or the like exists independently, and therefore, the press-formability and the sinterability are aggravated by the oxidation. When using the powder of Item (2), the oxidation is reduced compared with the case of using the powder of Item (1), but it is extremely hard, and therefore, the resistance against the plastic deformation is increased, with the result that the press-formability is aggravated. In the case where the powder of Item 3 is used, a sintered structure having a uniform composition is obtained compared with the case of using the powders of Items (1) and (2), but it is liable to be oxidized by water or gas. Further, it is extremely hard, and therefore, the press-formability is aggravated.

Furthermore, when a complete alloying into the Alnico system is required by using the above powders, a sintering has to be carried out at a high temperature for a long time.

Further, the particle size of the powder as the raw material has to be made as small as possible, and preferably to below 200 meshes (74 μm). However, if such a fine powder is used, the press-formability becomes insufficient, as well as expensive in the cost. Further, the sintered compact in which the powders having an insufficient formability are used is not dense in its micro-structural aspect, while the magnetic properties are weakened.

SUMMARY OF THE INVENTION

In order to overcome the above described disadvantages of the conventional techniques, the present inventor carried out studies and experiments, and the present invention is proposed based on the studies and the experiments.

Therefore it is the object of the present invention to provide a process for manufacturing an Alnico system permanent magnet, in which the alloy powder of the Alnico system having the proper composition is manufactured through a rapid solidification process, so that the pulverization ability and the formability should be superior, the sintered density should be high, and the magnetic properties should be excellent, as well as cheap in its manufacturing cost and simple in its manufacturing process.

DESCRIPTION OF THE PREFERRED EMBODIMENT

The process according to the present invention will be described below. That is, the process for manufacturing an Alnico system permanent magnet of using the major ingredients of Al—Ni—Co—Fe or Al—Ni—Fe will be described.

The alloy of Alnico system is subjected to a rapid solidification with a spinning solidifier wheel speed of 6–40 m/sec, thereby manufacturing a fine crystalline rapidly solidified powder. The powder is ground into a finer powder, and then a press-forming is carried out. Then a sintering is carried out at a temperature of 1100°–1350° C. for 0.5–4 hours. Then based on a continuous heat treatment, an external magnetizing force of 1–15 kOe is applied in a temperature range of 600°–1000° C., thereby carrying out the heat treatment under a magnetizing force. Thereafter, an aging heat treatment is carried out at a temperature of 500°–700° C. for 1–10 hours, thereby magnetizing the formed body. Thus an anisotropic Alnico permanent magnet is manufactured.

In another aspect of the present invention, the Alnico system permanent magnet having the major ingredients of Al—Ni—Co—Fe or Al—Ni—Fe is manufactured in the following manner. That is, based on a rapid solidifying method, an alloy of Alnico system is manufactured into a fine crystalline rapidly solidified powder, the powder is further ground into a finer powder, and then, a press-forming is carried out. Then a sintering is carried out 1100°–1350° C. for 0.5–4 hours, and then, an aging heat treatment is carried out at a temperature of 500°–700° C. for 1–10 hours, thereby manufacturing an isotropic Alnico system permanent magnet.

The present invention will be described in further detail below.

The rapid solidification technique of the present invention is based on the extractive melt spinning method which is disclosed in Korean Patent No. 48371. That is, the solidification is carried out at a wheel speed of 6–50 m/sec, and thus, a fine crystalline (1–30 μm) rapidly solidified powder can be obtained.

If the wheel speed is slower than 6 m/sec, the force for extracting the alloy melt is too weak, thereby making it impossible to obtain the powder. Meanwhile, even if the wheel speed is over 40 m/sec, it will be all right. However, in this case, a problem is encountered in the workability, and therefore, the wheel speed should be preferably 6–40 m/sec. Here, the particle shape is like a flake, and therefore, the brittleness is very high. Therefore, the pulverization ability is very good, and therefore, the grinding may be carried out in an organic solvent such as hexane, acetone, alcohol or the like or in the air. Thus a particle size of less than 250 meshes can be obtained. Meanwhile, the lowering of the formability and the sinterability due to the oxidation of Al, Ti, Nb and the like will not occur, so that the forming density and the sintering density should be improved. Further, the microstructure after the sintering becomes uniform, so that the magnetic properties should be improved.

The rapidly solidified powder which have been ground is charged into a die, and then, a press forming is carried out with a pressure of 1–10 ton/cm$^2$, thereby manufacturing a fabricated body. If the forming pressure is less than 1 ton/cm$^2$, the forming pressure is too low, so that it should be impossible to obtain the required strength. If the forming pressure is more than 10 ton/cm$^2$, the forming pressure is too high, so that the forming die may be damaged.

The formed body which is obtained in the above described manner is subjected to a sintering in a vacuum or under an argon or hydrogen atmosphere, thereby making it more dense. The sintering is carried out in a temperature range of 1100°–1350° C. for 0.5–4 hours. If the sintering temperature is below 1100° C., the sintering temperature is too low, and therefore, a sufficient densification does not occur, with the result that the magnetic properties are aggravated. If the sintering temperature is over 1350° C., the temperature is too high, and therefore, a melting occurs, with the result that the shape of the crystalline grains and the sintered structure are collapsed. Therefore the sintering temperature should be preferably 1100°–1350° C. Then the sintered body is subjected to a solution treatment at a temperature of 950°–1250° C. for 10–30 minutes, and then, a heat treatment is carried out in a temperature range of 950°–650° C. for 2–30 minutes under an external magnetizing force of 1–15 kOe.

The reason for carrying the heat treatment under a magnetizing force is Lo increase the precipitation of Fe— fine grains (the precipitate shows ferro-magnetic properties), and to grow them in an oriented arrangements.

In the case where the magnetizing treatment is carried out just after the sintering, the solution treatment can be skipped. If the magnetizing treatment is carried out for less than 2 minutes, the precipitation is not completed, with the result that the magnetic properties are aggravated. If the magnetizing treatment is carried out for more than 30 minutes, the precipitates become large and crude, with the result that the magnetic properties are aggravated. Therefore, the magnetizing treatment should be preferably carried out for 2–30 minutes.

When manufacturing an isotropic Alnico magnet, the magnetizing treatment may be skipped.

The aging treatment should be preferably carried out at a temperature of 500°–700° C. for 1–10 hours.

If the temperature for the aging treatment is below 500° C., then the effect is not sufficient. If it is over 700° C., the precipitates grow, and the magnetizing treatment effect is decreased. Therefore, the temperature for the aging treatment should be preferably limited to 500°–700° C.

Now the present invention will be described based on actual examples.

EXAMPLE 1

Ingots of Al, Ni, Co, Cu, and Fe were measured into a composition of 8 wt % (to be called % below) Al-14% Ni-24% Co-3% Cu-51% Fe which was an Alnico 5 composition. Then the alloy was completely melted by means of a plasma arc under an argon atmosphere, and then, a rapidly solidified powder having the shape of flake was manufactured. The solidifying speed, i.e., the wheel speed of the solidifying apparatus was varied within the range of 8.5–32.7 m/sec.

For the rapidly solidified powders thus obtained, X-ray diffraction analysis were carried out, the average crystalline grain size was measured, and the results are shown in Table 1 below.

TABLE 1

| Magnetic alloy composition | Wheel speed (m/sec) | Matrix | Average crystalline size (μm) | Powder No. |
|---|---|---|---|---|
| 8%Al—14%Ni—24%Co—3%Cu—51%Fe | 8.50 | Crystalline | 25.6 | Inventive 1 |
| " | 16.36 | " | 13.8 | Inventive 2 |
| " | 24.60 | " | 4.8 | Inventive 3 |
| " | 32.72 | " | 2.5 | Inventive 4 |

The respective rapidly solidified powders were pulverized within alcohol by using an attritor. Then a 400-mesh sieve which is specified in the ASTM E11 was used to sort the powders, thereby obtaining powders having a particle size of less than 38 μm. The powders thus ground were press-formed by applying a vertical pressure of 8 t/cm$^2$, and the formed body was sintered at a temperature of 1350° C. for 1 hour within vacuum. Then the sintered body was subjected to a solution treatment at a temperature of 1250° C. for 10 minutes. Then it was cooled to a temperature range of 900°–650° C. under an external magnetizing force of 7 kOe, and then, an aging treatment was carried out at a temperature of 600° C. for 4 hours, thereby obtaining a test piece of a permanent magnet.

For the test piece of the permanent magnet thus manufactured, the density and the magnetic properties were measured, and the results are shown in Table 2. That is, the magnetic alloys of Table 1 are shown in Table 2 together with the conventional permanent magnets manufactured based on the melt casting method and the powder metallurgical method.

TABLE 2

| Test piece | Wheel speed (m/sec) | Residue flux density (Br) (kG) | Coercv force (Hc) (Oe) | Maxim engy product ((BH)max) (MGOe) | Density g/cm$^3$ | Remarks |
|---|---|---|---|---|---|---|
| Conventional a | — | 12.8 | 680 | 5.0 | 7.3 | Casting |
| Conventional b | — | 12.3 | 650 | 4.5 | 7.0 | Powder |
| Inventive 1 | 8.50 | 13.25 | 678 | 6.08 | 7.3 | Melt- |
| Inventive 2 | 16.36 | 13.20 | 672 | 5.53 | 7.3 | spun |
| Inventive 3 | 24.60 | 13.15 | 670 | 5.40 | 7.3 | powder |
| Inventive 4 | 32.72 | 13.0 | 668 | 5.23 | 7.3 | |

As shown in Table 2 above, the permanent magnets (Inventive material 1–4) show the maximum energy product improved by about 5–20% compared with the conventional permanent magnet (Conventional material a), and improved by about 15–33% compared with the conventional permanent magnet (conventional material b), while the sintering density is also increased.

EXAMPLE 2

Ingots of Al, Ni, Co, Cu and Fe were measured into a composition of 10% Al-17% Ni-12.5% Co-6% Cu-54.5% Fe which is an Alnico composition 2. The alloy was completely melted by means of a plasma arc under an argon atmosphere. Then an extractive melt spinning apparatus was used to manufacture a flake shaped powder. Here, the solidifying speed, i.e., the wheel speed of the solidifying apparatus was 8.51 m/sec. For the rapid solidified powder, an X-ray diffraction analysis was carried out, and it was confirmed that the powder was of a micro-crystalline structure.

This rapidly solidified powders were ground within alcohol by using an attritor, and a sieve of 400 meshes was used so as to obtain powders having a particle size of 38 μm. The powders thus ground were press-formed with a vertical pressure of 8 t/cm$^2$, and the formed body was sintered at a temperature of 1350° C. in vacuum for 1 hour. Then the sintered body was subjected to an aging treatment at a temperature of 600° C. for 4 hours, thereby obtaining a test piece of permanent magnet.

For the test piece of the permanent magnet manufactured in the above described manner, density and magnetic properties were measured, and the results are shown in Table 3 below together with the conventional permanent magnets which were manufactured based on the casting method and the previous powder method.

TABLE 3

| | Magnetic properties | | | Density | |
|---|---|---|---|---|---|
| Test piece | Br(kG) | Hc(Oe) | (BH)max | g/cm$^3$ | Remarks |
| Convntnl | | | | | |
| c | 7.0 | 600 | 1.8 | 7.1 | Casting |
| d | 6.5 | 50 | 1.5 | 6.8 | Powder |
| Inventive 5 | 7.2 | 620 | 1.7 | 7.1 | Melt-spun powder |

As shown in Table 3 above, the sintered permanent magnet of the present invention (Inventive material 5) is superior in the magnetic properties compared with the conventional permanent magnets (conventional materials c and d) which were manufactured based on the casting method and the previous powder method.

EXAMPLE 3

The Alnico composition 5 which has the composition of 8% Al-14% Ni-24% Co-3% Cu-51% Fe was formed, and the composition was completely alloyed by means of a plasma arc under an argon atmosphere. Then an extractive melt spinning apparatus was used to manufacture a rapidly solidified powders shaped like flake. The solidifying speed, i.e., the wheel speed of the solidifying apparatus was 16.3 m/sec.

For the rapidly solidified powders manufactured as described above, an X-ray diffraction analysis was carried out, and confirmed that it had a micro-crystalline structure.

The rapidly solidified powders were ground within alcohol by using an attritor, and then, a sieve of 400 meshes was used to obtain powders having a particle size of less than 38 μm.

This ground powder was press-formed by using a vertical pressure of 8 ton/cm$^2$ and these formed bodies were sintered for 1 hour at the temperature condition of Table 4 below.

These sintered bodies were subjected to a solution treatment at a temperature of 1250° C. for 10 minutes, and were cooled to a temperature range of 900°–650° C. under an external magnetizing force of 7 kOe. Then an aging treatment was carried out at a temperature of 600° C. for 4 hours, thereby obtaining test pieces of permanent magnet.

For the test pieces of the permanent magnet manufactured in the above described manner, density and magnetic properties were measured, and the results are shown in Table 4 below.

TABLE 4

| | | Magnetic properties | | | |
|---|---|---|---|---|---|
| Test pieces | Sint temp (°C) | Residue (kG) | Coercive (Oe) | Max eny product (MGOe) | Density (g/cm$^3$) |
| Inventive | | | | | |
| 6 | 1275 | 12.5 | 643 | 4.55 | 7.1 |
| 7 | 1300 | 12.8 | 658 | 4.85 | 7.2 |
| 8 | 1325 | 13.05 | 665 | 5.32 | 7.3 |
| 9 | 1350 | 13.2 | 672 | 5.53 | 7.3 |

As shown in Table 4 above, the permanent magnets manufactured according to the method of the present invention have high densities and superior magnetic properties. It is seen that if the sintering temperature is stepped up, the density is increased, and the magnetic properties are improved.

What is claimed is:

1. A process for manufacturing an Alnico based permanent magnet, comprising the steps of:

providing a melt of an Alnico alloy comprising one selected form the group of major Alnico constituents consisting of Al—Ni—Co—Fe and Al—Ni—Fe;

rapidly solidifying the Alnico alloy using a spinning solidifier wheel rotating at a speed of 6–40 m/sec. to provide a micro-crystalline, rapidly solidified powder;

grinding the rapidly solidified powder to provide a finer sized powder;

press forming the finer sized powder to provide a formed body;

sintering the pressed shape at a temperature of 1100°–1350° C. for 0.5 to 4 hours to provide a sintered body;

heat treating the sintered body in a temperature range of 600°–1000° C. and simultaneously applying an external magnetizing force of 1–15 kOe; and aging said heat treated body at a temperature of 500°–700° C. for 1–10 hours to magnetize the formed body.

2. A process for manufacturing an Alnico based permanent magnet, comprising the steps of:

providing a micro-crystalline, rapidly solidified powder of an Alnico alloy, comprising one selected from the group of major Alnico constituents consisting of Al—Ni—Co— Fe and Al—Ni—Fe;

grinding the rapidly solidified powder to provide a finer sized powder;

press-forming the finer sized powder to provide a formed body;

sintering the formed body at a temperature of 1100°–1350° C. for 0.5 to 4 hours; and aging the sintered body at a temperature of 500°–700° C. for 1–10 hours, whereby an Alnico permanent magnet is formed.

* * * * *

UNITED STATES PATENT AND TRADEMARK OFFICE

CERTIFICATE OF CORRECTION

PATENT NO. : 5,520,748

DATED : May 28, 1996

INVENTOR(S) : Choong J. Yang, Seung D. Choi, Woo Y. Lee and Young G. Son

It is certified that error appears in the above-indentified patent and that said Letters Patent is hereby corrected as shown below:

Title page, delete "[22] Filed: Mar. 9, 1995" and insert the following:

--[22] PCT Filed: Jul. 27, 1994
[86] PCT No.: PCT/KR94/00100
§ 371 Date: Mar. 9, 1995
§ 102(e) Date: Mar. 9, 1995
[87] PCT Pub. No.: WO 95/04362
PCT Pub. Date: Feb. 9, 1995--.

Column 3 Line 56 "Lo" should read --to--.

Column 3 Line 56 "Fe— fine" should read --Fe—Co fine--.

Claim 1 Line 66 Column 6 "form" should read --from--.

Claim 2 Line 5 Column 8 "Al—Ni—Co— Fe" should read --Al—Ni—Co—Fe--.

Signed and Sealed this

Seventeenth Day of September, 1996

*Attest:*

Bruce Lehman

BRUCE LEHMAN

*Attesting Officer*

*Commissioner of Patents and Trademarks*